United States Patent [19]

Lardner

[11] Patent Number: 4,553,586

[45] Date of Patent: Nov. 19, 1985

[54] MOTOR VEHICLE OIL COOLER

[75] Inventor: Graham G. Lardner, Llanelli, Wales

[73] Assignee: Unipart Group Limited, England

[21] Appl. No.: 504,493

[22] Filed: Jun. 15, 1983

[30] Foreign Application Priority Data

Jun. 19, 1982 [GB] United Kingdom ..... 8217836

[51] Int. Cl.[4] ..... F28F 9/06

[52] U.S. Cl. ..... 165/76; 165/141; 165/916; 285/162; 285/196; 285/388

[58] Field of Search ..... 165/76, 178, 141, 154, 165/69, 140; 285/162, 196, 388

[56] References Cited

U.S. PATENT DOCUMENTS

| | | | |
|---|---|---|---|
| 2,240,537 | 5/1941 | Young | 165/178 |
| 3,861,162 | 1/1975 | Horton et al. | 165/154 |
| 3,953,555 | 3/1976 | Gley | 285/162 |
| 3,976,129 | 8/1976 | Silver | 165/154 |
| 4,094,358 | 6/1978 | Neveux | 165/154 |
| 4,141,477 | 2/1979 | Hengesbach | 285/162 |
| 4,232,421 | 11/1980 | Tucker | 285/162 |
| 4,392,526 | 7/1983 | Hage et al. | 165/154 |

*Primary Examiner*—William R. Cline

*Attorney, Agent, or Firm*—Thomas J. Greer, Jr.

[57] ABSTRACT

A motor vehicle radiator has a tubular oil cooler 12 located in its header tank defined by a plastics header tank shell 11 and a tube plate 20. Passage of oil to the oil cooler is effected through connectors 14 which include an elastomeric sealing bush 16 which is tapered internally in its undeformed state such that upon insertion of a connecting piece 15 the bush is expanded radially outwardly into sealing contact with the header tank shell.

9 Claims, 4 Drawing Figures

MOTOR VEHICLE OIL COOLER

This invention relates to heat exchangers having a header tank shell incorporating a connector passing through an aperture in the wall of the shell to permit fluid to be passed through the aperture.

Such arrangements are known in connection with such as motor vehicle radiators wherein a tubular heat exchanger constituting an oil cooler is located within the header tank shell of the normal coolant radiator, and some form of connector is necessary at each end of the oil cooler to permit oil to be passed to and from the tubular heat exchanger through the wall of the radiator header tank shell. In the past, such heat exchangers have incorporated connectors which include a threaded portion passing through the aperture in the header tank shell, the threaded portion carrying a flange at one end and a nut at the other side of the shell wall to draw the flange and an associated sealing ring into contact with the shell wall. The threaded connector is hollow to permit oil flow therethrough.

According to the present invention there is provided a heat exchanger having a header tank shell incorporating a connector passing through an aperture in the wall of said shell to permit fluid to be passed through said aperture, wherein a seal is effected between said connector and said shell wall by means of an elastomeric bush including a portion which is located around said connector where it passes through said shell wall, said bush being tapered internally in its undeformed state such that insertion of said connector into said bush causes said bush to be expanded into sealing contact with said shell wall.

An embodiment of the invention will now be described, by way of example, with reference to the accompanying drawings, in which.

Figure 1:
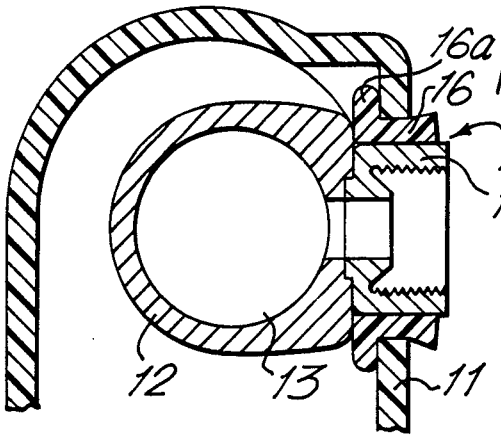
FIG. 1 is a cross-section through a header tank shell incorporating a tubular heat exchanger and a connector therefor, of a heat exchanger in accordance with the invention.
Figure 2:
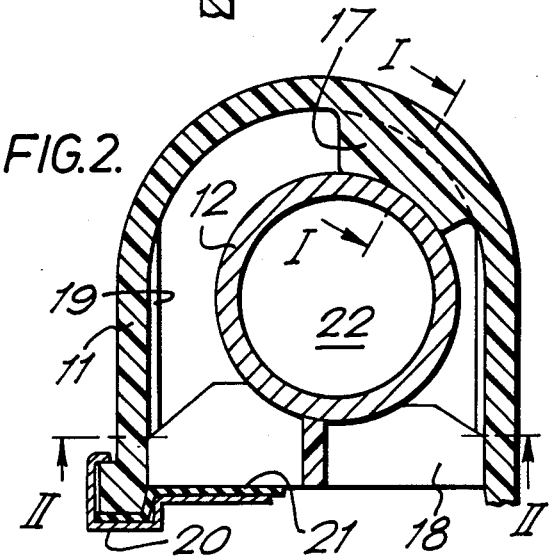
FIG. 2 is a further cross section taken on another plane through the header tank of the heat exchanger of FIG. 1.
Figure 3:
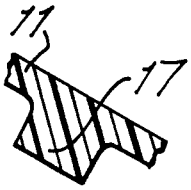
FIG. 3 is a cross section taken on the line I—I of FIG. 2.
Figure 4:
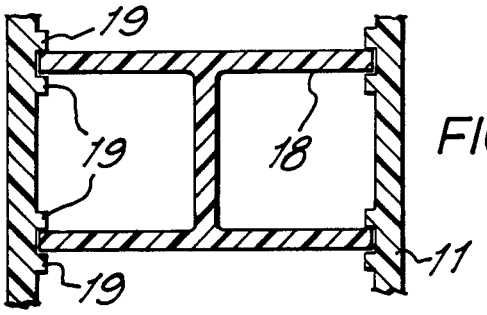
FIG. 4 is a cross section taken on the line II—II of FIG. 2.

As shown in the drawings, a moulded plastics header tank shell 11 contains a so-called concentric oil cooler 12 made of copper. Oil flow to and from the interior 13 of the oil cooler is by way of a pair of connectors 14, one of which is shown in FIG. 1.

Connector 14 consists of a brass connecting piece 15 soldered to the tubular oil cooler 12, and an elastomeric annular sealing bush interposed between the connecting piece and the header tank shell. Connecting piece 15 is adapted for connection to oil carrying pipes (not shown), and has a substantially cylindrical outer surface which contacts the sealing bush 16. Sealing bush 16 has, in its undeformed state, a cylindrical outer surface which is terminated at one end by a flange 16*a*, and a tapered inner surface which contacts the cylindrical outer surface of the connecting piece 15. The bush is shaped such that it has a maximum internal diameter in its undeformed state at its flanged end, tapering to a minimum internal diameter at the other end.

The tubular oil cooler 12 is located within the header tank shell by means of webs 17 moulded integrally with the shell and H-shaped retaining members 18. A plurality of webs 17 and retaining members 18 are disposed along the length of the tubular oil cooler 12 to ensure proper location. Webs 17 restrain the oil cooler against movement toward the aperture in the shell wall through which the connectors 14 extend, and also against movement in a direction perpendicular thereto, into the header tank shell. Retaining members 18 restrain the oil cooler against movement in the opposite two directions. The retaining members 18 are located in guides 19 moulded in the header tank shell, and are held captive in the assembled heat exchanger by a tube plate 20, acting through a gasket 21. The H-shaped retaining members 18 are shaped to take up a substantial part of the cross-sectional area of the header tank whereby to influence the flow of water in the tank to encourage flow through the internal passage 22 in the oil cooler.

Assembly of the illustrated components is commenced by inserting the sealing bushes 16 through the apertures in the shell wall. The oil cooler is then forced into position, engaging the connecting pieces 15 in the larger ends of the bushes and sliding the connecting pieces through into the position shown wherein the tapered interior of the sealing bush has been forced to conform to the cylindrical outer surface of the connecting piece 15, deforming the bush radially outwardly so that it is expanded into sealing contact with the shell wall. The H-shaped retaining members are then slid into the guides 19 to positively locate the oil cooler in place, the header tank assembly subsequently being assembled to the tube plate and gasket to prevent dissassembly of the H-shaped retaining members.

It will be seen that assembly of the illustrated components is very simple and that an effective seal has been created between the connecting piece 15 and the header tank shell without the need to provide a threaded connecting piece and associated nut, thus saving assembly time and material costs. At the same time, the oil cooler has been retained positively in place inside the header tank by means which are used to improve the flow, and hence the heat transfer characteristics of the heat exchanger.

It will be apparent that numerous changes to the detailed shape and disposition of the components could be effected without departing from the scope of the invention. For example, while a plastics header tank has been illustrated, the invention could be readily adapted to use with metal header tank shells. Moreover although the invention has been illustrated in the context of radiator header tank mounted oil coolers, to which it is particularly relevant, a similar connector could be employed in other roles in heat exchanger header tanks wherein components must necessarily pass through the shell wall.

What is claimed is:

1. A heat exchanger including: a header tank shell, a heat exchanger located with the shell, a hollow connector passing through an aperture in a wall of the shell to permit fluid to be passed through the aperture to and from the heat exchanger, an elastomeric bush having a bore, the bush effecting a seal between the hollow connector and the shell wall, the bush including a portion which is located around the hollow connector where it passes through the shell wall, the bore of the elastomeric bush being tapered in its undeformed state from one bore end to the other bore end such that insertion of the connector into the elastomeric bush causes the bush to be expanded into sealing contact with the rim of the aperture in the shell wall, and a retaining member within the shell abutting and restraining the heat exchanger against movement away from the aperture in the shell wall through which the hollow connector passes, the heat exchanger also being located in the shell by an integral web moulded in the shell and opposing said retaining member, the web constraining the heat exchanger against movement in a direction towards the aperture in the shell and also in a direction perpendicular to the said direction.

2. A heat exchanger as claimed in claim 1, wherein the retaining member is insertable into the shell subsequent to the insertion of the heat exchanger therein, and is retained by a tube plate connected to the shell, the retaining member constraining the heat exchanger against movement in a direction opposite to the said perpendicular direction.

3. A heat exchanger as claimed in claim 2, wherein the retaining member is H-shaped to act as a baffle for fluid flow in the shell.

4. A heat exchanger as claim 1, wherein the elastomeric bush is substantially cylindrical externally over its length in its undeformed state.

5. A heat exchanger as claimed in claim 4, wherein the aperture in the shell wall is circular, and wherein the elastomeric bush and the connector are both annular.

6. A heat exchanger as claimed in claim 1, wherein the elastomeric bush has an external and integral flange which extends radially outwardly and is located on the elastomeric bush adjacent the larger end of the tapered bore, the flange positioned interiorly of the shell.

7. A heat exchanger as claimed in claim 1, wherein the external surface of the connector is substantially cylindrical over that portion which contacts the elastomeric bush.

8. A heat exchanger as claimed in claim 1, wherein the heat exchanger is a tubular heat exchanger.

9. The heat exchanger as claimed in claim 1 wherein the shell is of a plastics material.

* * * * *